US008011761B2

(12) United States Patent
Matsuzawa

(10) Patent No.: US 8,011,761 B2
(45) Date of Patent: Sep. 6, 2011

(54) LIQUID JET HEAD AND A LIQUID JET APPARATUS

(75) Inventor: Akira Matsuzawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 202 days.

(21) Appl. No.: 12/355,639

(22) Filed: Jan. 16, 2009

(65) Prior Publication Data

US 2009/0185011 A1 Jul. 23, 2009

(30) Foreign Application Priority Data

Jan. 17, 2008 (JP) ..... 2008-007665
Dec. 26, 2008 (JP) ..... 2008-332954

(51) Int. Cl.
*B41J 2/045* (2006.01)

(52) U.S. Cl. ..... 347/68; 347/70

(58) Field of Classification Search ..... 347/68–72
See application file for complete search history.

(56) References Cited

U.S. PATENT DOCUMENTS

2005/0185025 A1* 8/2005 Shimada et al. ..... 347/68
2006/0098058 A1* 5/2006 Yazaki ..... 347/72

FOREIGN PATENT DOCUMENTS

JP 2007-098812 A 4/2007

* cited by examiner

*Primary Examiner* — Geoffrey Mruk
(74) *Attorney, Agent, or Firm* — Kilpatrick Townsend & Stockton LLP

(57) ABSTRACT

A plurality of pressure generating chambers being formed of a silicon substrate, in which a crystal face orientation of a surface is a (110) plane, and each pressure generating chambers communicating with nozzles in parallel. Piezoelectric elements are formed on one surface of the substrate with a vibration plate interposed therebetween and include a lower electrode film, a piezoelectric layer, and an upper electrode film. In each of the pressure generating chambers, an end surface is formed of a first (111) plane perpendicular to the (110) plane and an end surface in a longitudinal direction is formed of a second (111) plane inclined by a predetermined angle with respect to the first (111) plane.

4 Claims, 5 Drawing Sheets

LIQUID JET HEAD AND A LIQUID JET APPARATUS

BACKGROUND

The entire disclosure of Japanese Patent Application No. 2008-007665, filed Jan. 17, 2008 is incorporated by reference herein.

The entire disclosure of Japanese Patent Application No. 2008-332954, filed Dec. 26, 2008 is incorporated by reference herein.

1. Technical Field

The present invention relates to a liquid jet head and a liquid jet apparatus ejecting liquid droplets from nozzles, and particularly to an ink jet print head and an ink jet printing apparatus ejecting ink droplets as liquid droplets.

2. Related Art

As an ink jet print head which is a representative example of a liquid jet head, there is known an ink jet print head which includes a passage forming substrate provided with pressure generating chambers for communicating with nozzles and piezoelectric elements on one surface of the passage forming substrate and in which a silicon substrate with a crystal face orientation of a (110) plane is used as the passage forming substrate and pressure generating chambers are formed by performing anisotropic etching (wet etching) on the passage forming substrate formed of the silicon substrate.

In the ink jet print head having the above-described configuration, the pressure generating chambers each have first and second (111) planes perpendicular to the (110) plane as the silicon substrate so as to be formed in a substantially parallelogram opening shape. As for the pressure generating chamber having this opening shape, ends of lower and upper electrodes included in a piezoelectric element are generally formed in a width direction (transverse direction) of the pressure generating chamber (for example, see JP-A-2007-098812).

In this configuration, the piezoelectric element extends in a longitudinal direction of the pressure generating chamber up to the outside of the pressure generating chamber, but the piezoelectric element is formed inside the pressure generating chamber in some cases. That is, the ends of lower and upper electrodes of the piezoelectric element are located inside the pressure generating chamber. In this configuration, when the ends of the lower and upper electrodes included in the piezoelectric element are formed in the width direction of the pressure generating chamber, a distance between the end of the pressure generating chamber in the longitudinal direction and the end of the piezoelectric element is not uniform in the width direction of the pressure generating chamber. For that reason, a displacement amount of a vibration plate by drive of the piezoelectric element in the end in the longitudinal direction of the pressure generating chamber is not uniform in the width direction of the pressure generating chamber. That is, the displacement amount of the vibration plate in accordance with drive of the piezoelectric element is increased, as the distance between the end of the pressure generating chamber in the longitudinal direction and the end of the piezoelectric element is longer. Accordingly, a problem may occur in that the vibration plate of the end in the longitudinal direction of the pressure generating chamber or the piezoelectric element is broken down (cracked) due to a difference in the displacement amount of the vibration plate.

This problem occurs not only in the ink jet print head ejecting ink droplets and but also in other liquid jet heads ejecting liquid droplets other than the ink droplets.

The invention is devised in view of the above-mentioned circumstance and an object of the invention is to provide a liquid jet head and a liquid jet apparatus capable of preventing a vibration plate or the like from being broken down due to drive of a piezoelectric element. In order to solve the above-mentioned problems, according to an aspect of the invention, there is provided a liquid jet head including: a passage forming substrate in which a pressure generating chamber being formed of a silicon substrate, in which a crystal face orientation of a surface is a (110) plane, and communicating with a nozzle ejecting liquid droplets; and a piezoelectric element which is formed above one surface of the passage forming substrate with a vibration plate interposed therebetween and each includes a lower electrode, a piezoelectric layer, and an upper electrode. In the pressure generating chamber, an end surface in a width direction thereof is formed of a first (111) plane perpendicular to the (110) plane and an end surface in a longitudinal direction thereof is formed of a second (111) plane inclined by a predetermined angle with respect to the first (111) plane. Ends of the lower electrode and the upper electrode in the longitudinal direction of the pressure generating chamber are located in a region opposite to between both ends in the longitudinal direction of the pressure generating chamber and formed in parallel to the end surface in the longitudinal direction of the pressure generating chamber. With such a configuration, a distance between the end in the longitudinal direction of the pressure generating chamber and the end of the piezoelectric element is uniform in the width direction of the piezoelectric element. Accordingly, it is possible to prevent the vibration plate or the like from being broken down in the end in the longitudinal direction of the pressure generating chamber.

Here, it is preferable that the piezoelectric layer extends from the end in the longitudinal direction of the pressure generating chamber to the outside of the pressure generating chamber and a lead electrode having an end connected to the upper electrode extends onto the piezoelectric layer to be drawn to the outside of the pressure generating chamber. With such a configuration, a displacement amount of the vibration plate in the end in the longitudinal direction of the pressure generating chamber is suppressed. Accordingly, it is possible to surely prevent the vibration plate from being broken down. Moreover, it is possible to scatter stress in the vibration plate.

It is preferable that the lower electrode and the upper electrode are patterned by dry etching. With such a configuration, the lower electrode and the upper electrode can be formed with high precision. Accordingly, it is possible to more surely prevent the vibration plate from being broken down.

It is preferable that the predetermined angle is an acute angle or an obtuse angle. In this way, when the predetermined angle formed between the first (111) plane and the second (111) plane of the pressure generating chamber is the acute angle or the obtuse angle, etching can be smoothly performed in correspondence with anisotropy of the silicon substrate. In addition, the length of the end (end side) of the second (111) plane contacting with the vibration plate can be set to be longer, compared to a case where the predetermined angle is a right angle. The end (end side) is a position where the piezoelectric element is displaced. When the length of the position is long, the stress applied per unit length is reduced. Accordingly, it is possible to obtain an advantage of improving a lift span of the vibration plate.

According to another aspect of the invention, there is provided a liquid jet apparatus including the liquid jet head described above. According to this aspect of the invention, it is possible to realize the liquid jet apparatus capable of improving reliability and durability.

10: PASSAGE FORMING SUBSTRATE
12: PRESSURE GENERATING CHAMBER
13: INK SUPPLY PASSAGE
14: COMMUNICATION PASSAGE
15: COMMUNICATION SECTION
20: NOZZLE PLATE
21: NOZZLE
30: PROTECTIVE SUBSTRATE
40: COMPLIANCE SUBSTRATE
50: ELASTIC FILM
55: INSULATING FILM
60: LOWER ELECTRODE FILM
70: PIEZOELECTRIC LAYER
80: UPPER ELECTRODE FILM
90: LEAD ELECTRODE
300: PIEZOELECTRIC ELEMENT

DESCRIPTION OF EXEMPLARY EMBODIMENTS

Hereinafter, embodiments of the invention will be described in detail.

First Embodiment

Figure 1:
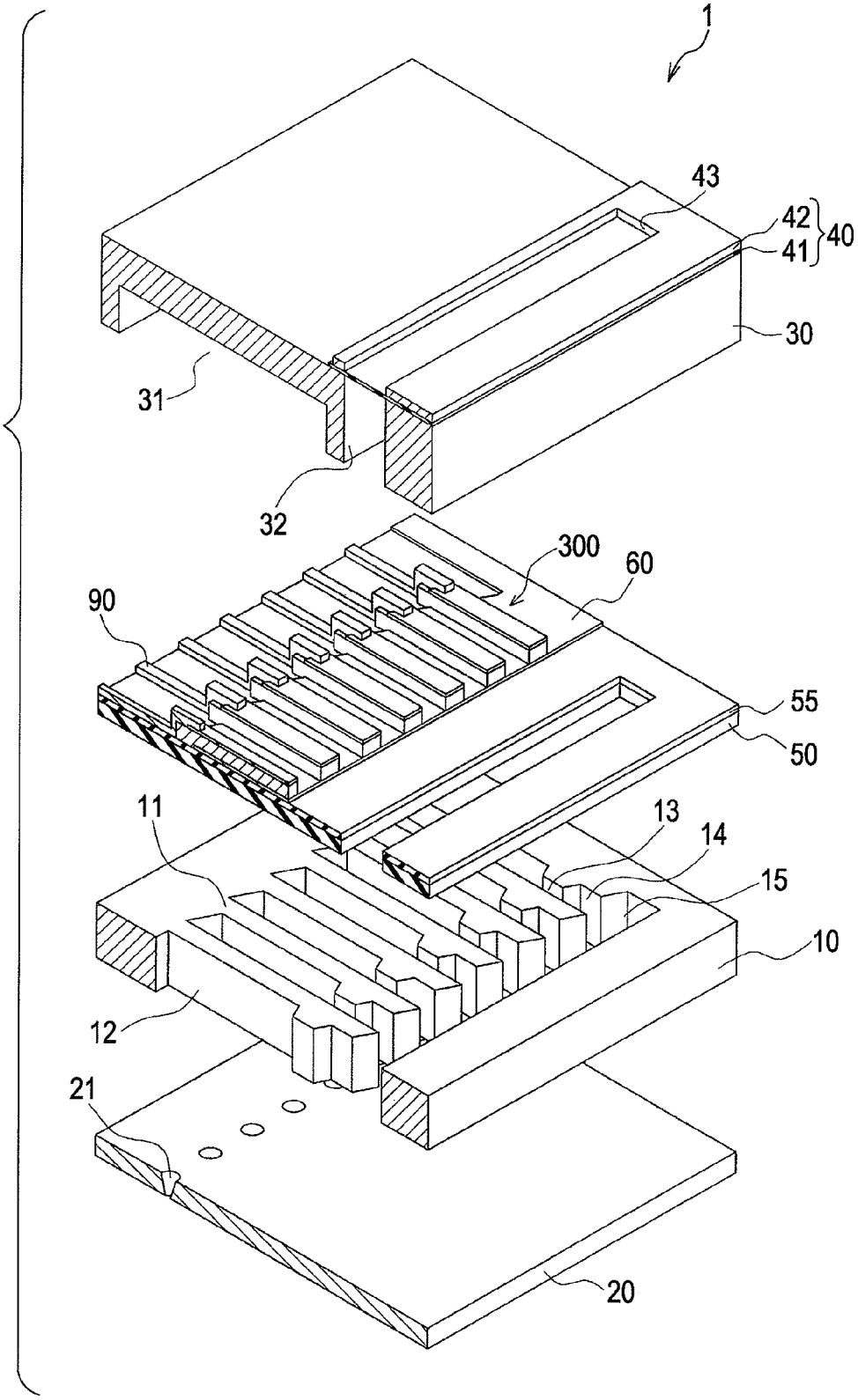
FIG. 1 is an exploded perspective view illustrating a print head according to an embodiment.
Figure 2:
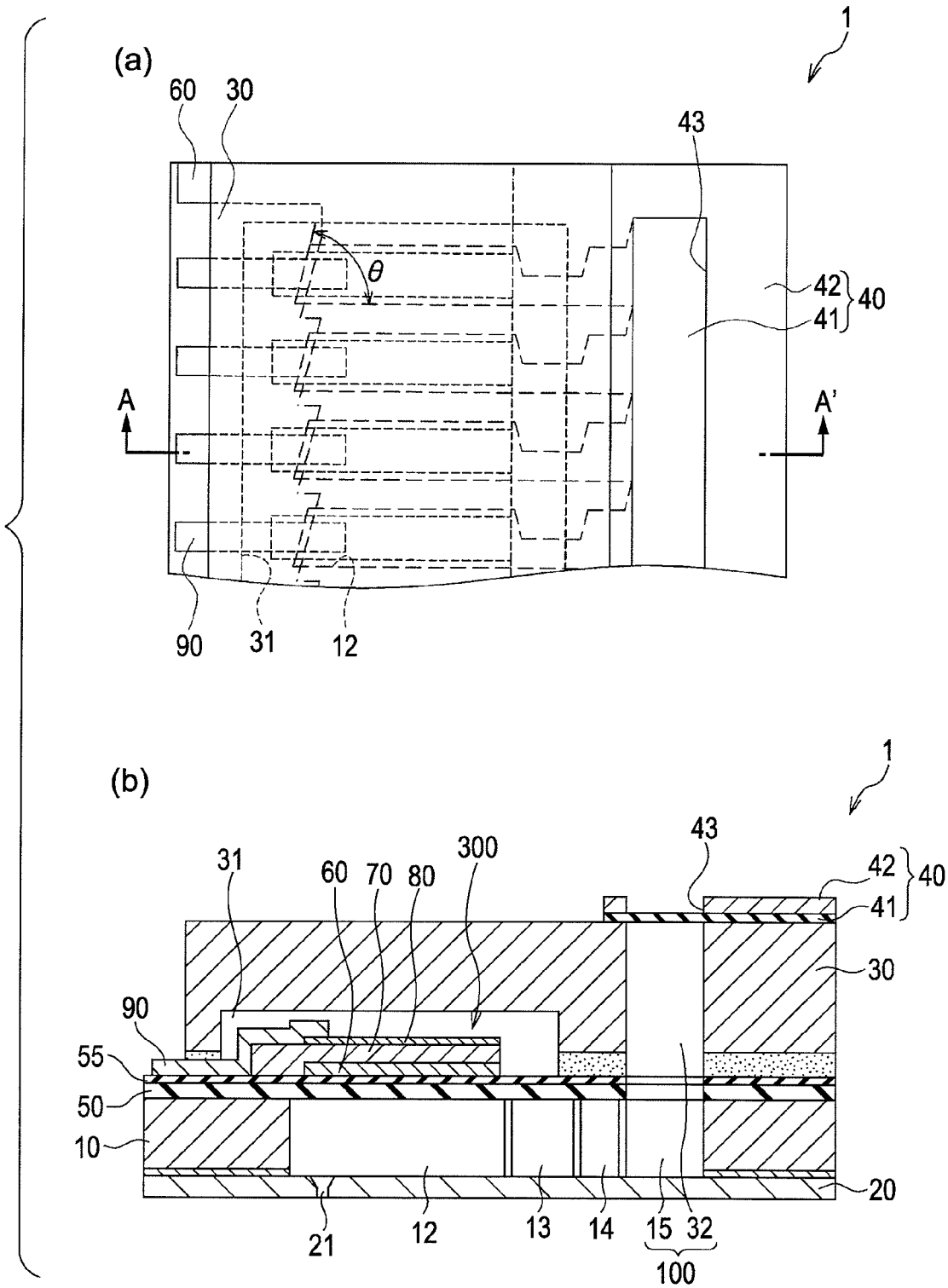
FIG. 2 is a top view and a sectional view illustrating the print head according to the embodiment.

FIG. 1 is an exploded perspective view illustrating an ink jet print head 1 as a liquid jet head according to a first embodiment of the invention. FIG. 2 is a top view and a sectional view taken along the line A-A' of FIG. 1.

As illustrated, a passage forming substrate 10 is formed of a silicon single crystal substrate of a face orientation (110). In addition, an elastic film 50 formed of silicon dioxide by thermal oxidation is formed in advance on one surface of the passage forming substrate. Pressure generating chambers 12 partitioned by a plurality of partition walls 11 are arranged in parallel in the passage forming substrate 10 in the width direction (transverse direction) of the passage forming substrate. Ink supply passages 13 and communication passages 14 are partitioned by the partition walls 11 in one ends in a longitudinal direction of the pressure generating chambers 12 of the passage forming substrate 10. A communication section 15 forming a part of a reservoir 100 as a common ink chamber (liquid chamber) of the pressure generating chambers 12 is formed in one ends of the communication passages 14.

The communication section 15 communicates with a reservoir section 32 of a protective substrate 30 described below to form a part of the reservoir 100 as a common ink chamber of the plurality of pressure generating chambers 12. Since each of the ink supply passages 13 is formed so as to have a width narrower than that of the pressure generating chamber 12, passage resistance of ink flowing from the communication section 15 to each of the pressure generating chambers 12 is uniformly maintained. In this embodiment, in the ink supply passage 13, the width of the passage is narrower on one side, but the width of the passage may be narrower on both sides, for example.

Here, the pressure generating chambers 12, the ink supply passages 13, the communication passage 14, and the communication section 15 formed in the passage forming substrate 10 is formed by performing anisotropic etching on the passage forming substrate 10 from a surface opposite the elastic film 50. The anisotropic etching is performed by using a difference between etching rates of the silicon single crystal substrate. In the case of the passage forming substrate 10 formed of the silicon substrate of the face orientation (110), the anisotropic etching is performed by using a characteristic in which an etching rate of a (111) plane is about 1/180 in comparison to an etching rate of the (110) plane.

Specifically, when a mask having a predetermined shape is formed on the surface of the silicon substrate as the passage forming substrate 10 and the silicon substrate is immersed in an alkali solution such as KOH, the silicon substrate is corroded gradually from an opening of the mask and a first (111) surface perpendicular to the (110) surface and a second (111) surface forming a predetermined angle θ (about 70.53 degree) with the first (111) surface appear, so that etching progresses. Passages such as the pressure generating chambers 12 are formed by etching the silicon substrate up to the elastic film 50.

In the pressure generating chamber 12, the end surfaces in the width direction (transverse direction) are formed by a first (111) plane and the end surfaces in the longitudinal direction are formed by a second (111) plane. In this embodiment, since one end of the pressure generating chamber 12 communicates with the ink supply passage 13, the end surface of the other end of the pressure generating chamber 12 is formed by the second (111) plane. That is, the end surface of the other end in the longitudinal direction of the pressure generating chamber 12 is inclined by a predetermined angle θ with respect to the end surface in the width direction.

A nozzle plate 20 through which nozzles 21 individually communicating with the vicinities of the ends opposite the ink supply passages 13 of the pressure generating chambers 12 are punched is fixed and adhered to an opening surface of the passage forming substrate 10 by an adhesive or a heat welding film. The nozzle plate 20 is formed of glass ceramics, a silicon single crystal substrate, stainless steel, or the like.

On the other hand, the elastic film 50 is formed opposite the opening surface of the passage forming substrate 10 and an insulating film 55 is formed on the elastic film 50. Piezoelectric elements 300 each including a lower electrode film (lower electrode) 60, a piezoelectric layer 70, and an upper electrode film (upper electrode) 80 are formed on the insulating film 55. In this embodiment, the lower electrode film 60 serves as a common electrode of the piezoelectric element 300 and the upper electrode film 80 serves as an individual electrode of the piezoelectric element 300. However, the reverse configuration is also possible depending on the restriction condition on a driving circuit or wirings. Here, each of the piezoelectric elements 300 and all vibration plates to be displaced due to drive of the piezoelectric elements 300 are referred to as an actuator. In addition, the vibration plate is a portion which forms one surface of the pressure generating chamber 12 and is deformed by drive of the piezoelectric element 300. In this embodiment, the elastic film 50, the insulating film 55, and the lower electrode film 60 serve as the vibration plate. Of course, the invention is not limited thereto. For example, only the lower electrode film 60 may serve as the vibration plate without providing the elastic film 50 and the insulating film 55. Alternatively, the piezoelectric elements 300 may practically serve as the vibration plate.

Figure 3:
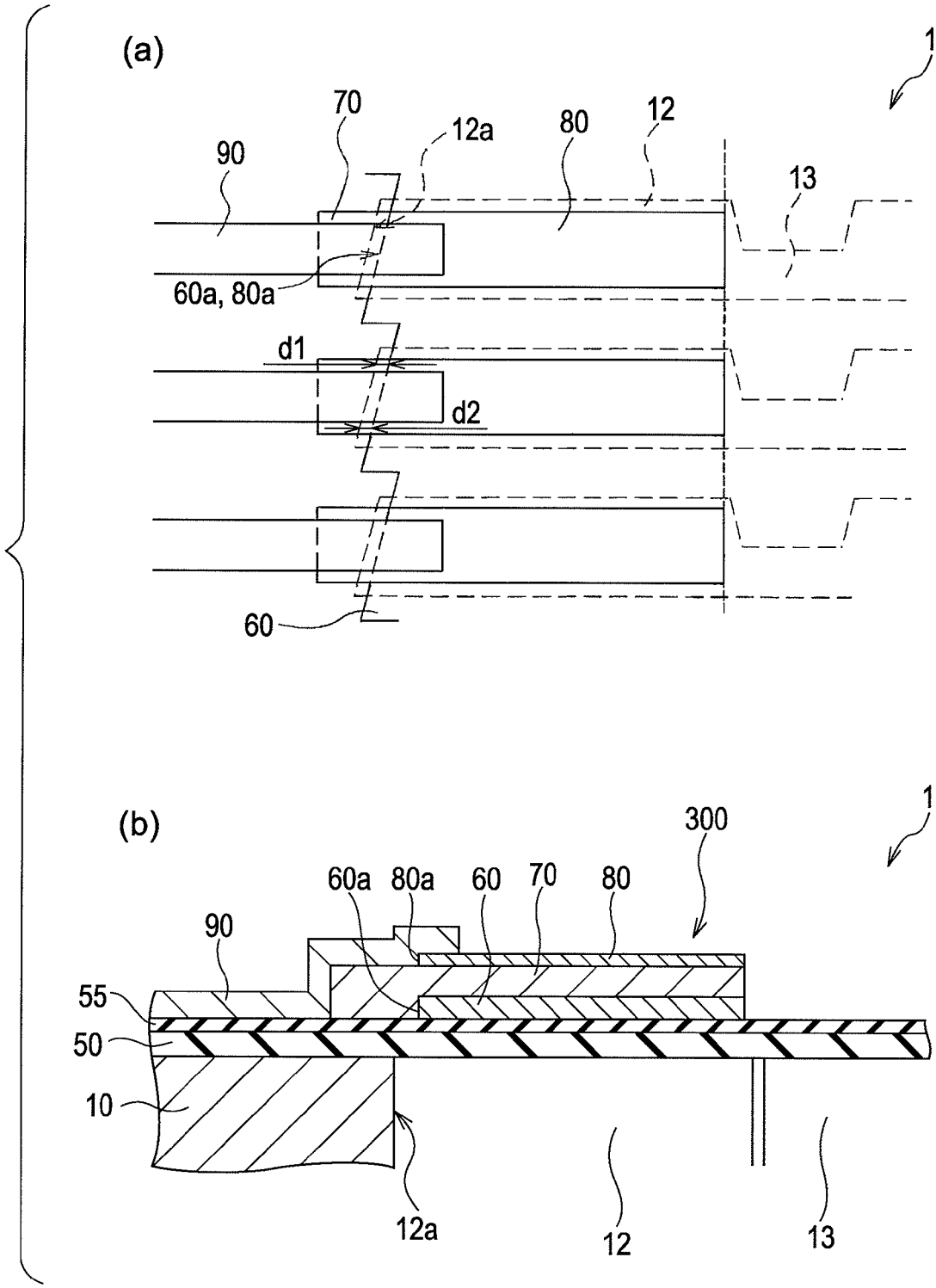
FIG. 3 is an enlarged view illustrating major constituent elements of the print head according to the embodiment.

As shown in FIG. 3, in this embodiment, each of the piezoelectric elements 300 is formed in an area opposite the pressure generating chamber 12. That is, in the other end in the longitudinal direction of the pressure generating chamber 12, the lower electrode film 60 and the upper electrode film 80 forming each of the piezoelectric elements 300 are patterned inside an end surface 12*a* (the second (111) plane) of the pressure generating chamber 12. In the pressure generating chamber 12, an end 60*a* of the lower electrode film 60 and an end 80*a* of the upper electrode film 80 are substantially parallel to the end surface 12*a* of the pressure generating chamber 12.

The lower electrode film 60 and the upper electrode film 80 having the above-described shape are formed by sequentially laminating the lower electrode film 60, the piezoelectric layer 70, and the upper electrode film 80 and patterning each layer at the time of forming each of the piezoelectric elements 300. The patterning method is not particularly limited. For example, it is preferable that dry etching such as ion milling is used. In this way, it is possible to form each of the piezoelectric elements 300 with high precision. Moreover, it is possible to surely form the end 60*a* of the lower electrode film 60 and the end 80*a* of the upper electrode film 80 to be parallel to the end surface 12*a* of the pressure generating chamber 12.

In this embodiment, the piezoelectric layer 70 is continuously provided up to the outside of the pressure generating chamber 12. A lead electrode 90 of which one end is connected to the upper electrode film 80 is formed on each of the piezoelectric layer 70. The other end of the lead electrode 90 extends up to the vicinity of the end of the passage forming substrate 10. Even though not shown, voltage is selectively applied to the piezoelectric elements 300 through the lead electrodes 90.

In the ink jet print head 1 having the above-described configuration, a distance between each of the ends of the piezoelectric element 300, that is, the end 60*a* of the lower electrode film 60 and the end 80*a* of the upper electrode film 80 and the end surface 12*a* of the pressure generating chamber 12 is substantially uniform in the width direction of the piezoelectric element 300. For example, distances d1 and d2 between both ends in the width direction of the piezoelectric element 300 and the end surface 12*a* of the pressure generating chamber 12 are also substantially equal to each other. Since the distance between the end of the piezoelectric element 300 and the end surface 12*a* of the pressure generating chamber 12 is uniform, a displacement amount of the vibration plate by drive of the piezoelectric element 300 is substantially uniform in the width direction of the piezoelectric element 300. Accordingly, when the piezoelectric element 300 is driven, the almost same stress is applied to the vibration plate in the vicinity of the end in the longitudinal direction of the pressure generating chamber 12 or the piezoelectric element 300. That is, since the stress is not applied to a specific position, the vibration plate or the piezoelectric element 300 can be prevented from being broken down due to the drive of the piezoelectric element 300. Since the piezoelectric layer 70 is continuously formed up to the outside of the pressure generating chamber 12, the piezoelectric layer is supported to the outside portion of the pressure generation chamber 12 and vibrates. Moreover, the piezoelectric layer also serves as scattering stress which occurs in the boundary between the pressure generating chamber 12 and the partition wall 11 in the vibration plate.

In this embodiment, since the ink supply passage 13 perforated through the passage forming substrate 10 in the thickness direction communicates with one end of the pressure generating chamber 12, the vibration plate is not broken down regardless of the end shape of the piezoelectric element 300. The end of the piezoelectric element 300 opposite the end surface 12*a* of the pressure generating chamber 12 which is an end of the passage is formed so as to be substantially parallel to the end surface 12*a* of the pressure generating chamber 12, as described above.

As shown in FIG. 2, in the passage forming substrate 10 in which the piezoelectric elements 300 are formed the protective substrate 30 including piezoelectric element preservers 31 which each have a space so as not to interrupt the movement of the piezoelectric element 300 is additionally joined to areas opposite the piezoelectric elements 300. Each of the piezoelectric element preservers 31 is configured so as to have the space so as not to interrupt the movement of the piezoelectric element 300. In addition, the space may be airtightly sealed or not sealed. The protective substrate 30 is provided with the reservoir section 32 in the area opposite the communication section 15 of the passage forming substrate 10. The reservoir section 32 communicates with the communication section 15 to form the reservoir 100 common to the pressure generating chambers 12, as described above.

It is preferable that the protective substrate 30 is made of a material such as glass or a ceramic material having the substantially same thermal expansibility as that of the passage forming substrate 10. For example, a silicon single crystal substrate which is the same material as that of the passage forming substrate 10 is appropriately used.

A compliance substrate 40 including a sealing film 41 and a fixing plate 42 is joined onto the protective substrate 30. The sealing film 41 is made of an organic insulation material having a low rigidity and a flexible property. One surface of the reservoir section 32 is sealed by the sealing film 41. The fixing plate 42 is made of a material such as metal having a hard property. Since an area opposite the reservoir 100 of the fixing plate 42 is an opening 43 completely removed in the thickness direction, one surface of the reservoir 100 is sealed only by the sealing film 41 having a flexible property.

The embodiment of the invention has been described, but the invention is not limited the first embodiment. For example, in the first embodiment, the ink supply passage 13 perforated through the passage forming substrate 10 in the thickness direction is configured to communicate with the pressure generating chamber 12. However, the ink passage may be configured according to a second embodiment described below.

Second Embodiment

Figure 4:
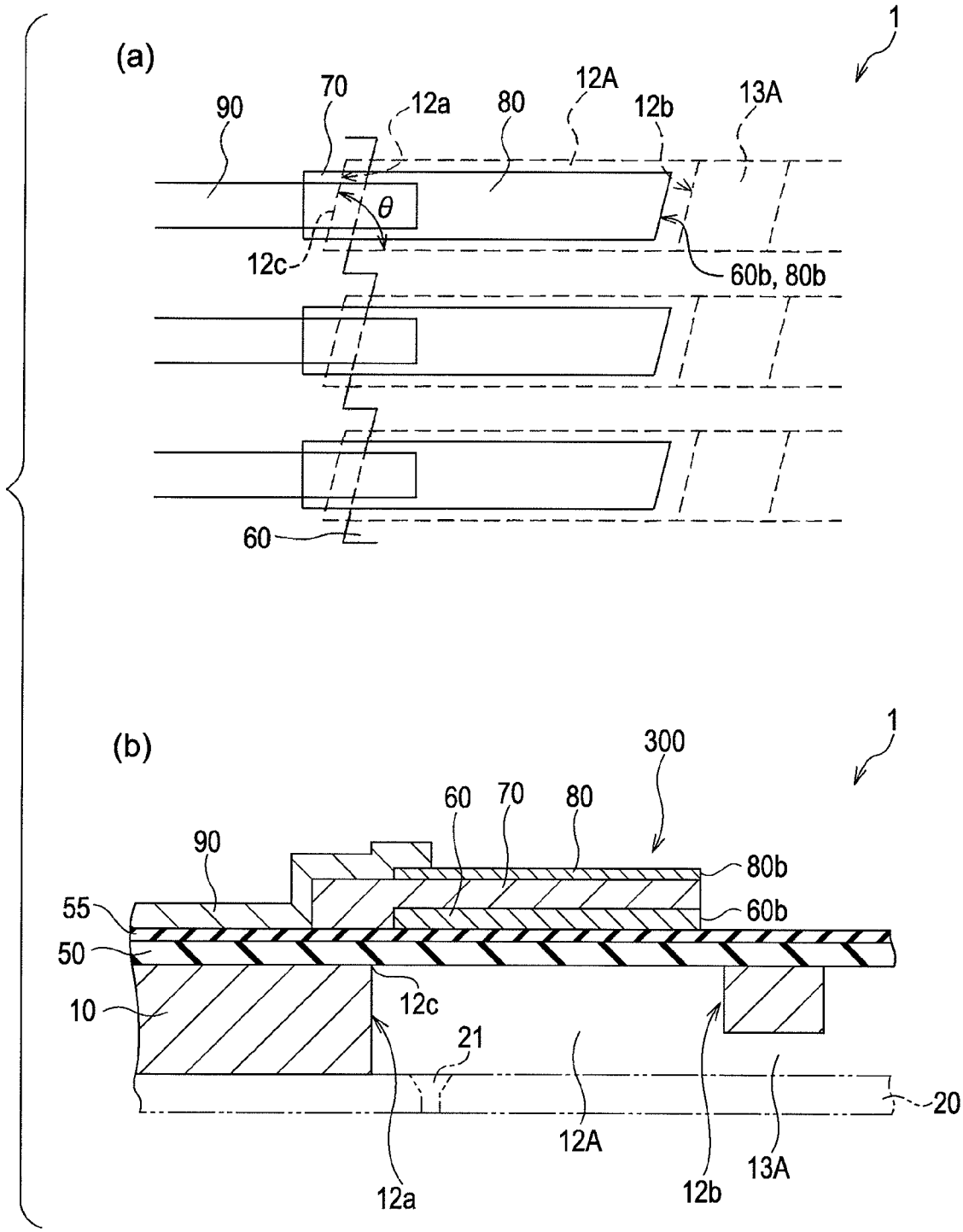
FIG. 4 is an enlarged view illustrating a print head according to a modified example of the embodiment.

In the second embodiment, as shown in FIG. 4, ink supply passages 13A are formed by partially removing the passage formation substrate 10 in the thickness direction. In this case, in the end of elastic film 50 of the passage forming substrate 10, an end surface 12*b* of one end in the longitudinal direction of the pressure generating chamber 12A is formed in the same shape as that of the end surface 12*a* of the other end in the longitudinal direction (see (a) FIG. 4). That is, in this case, the pressure generating chamber 12A has a parallelogram shape in the end of the elastic film 50. The end surfaces 12*a* and 12*b* of both the ends in the longitudinal direction of the pressure generating chamber 12A are each formed of a second (111) plane. With such a configuration, in both the ends in the longitudinal direction of the pressure generating chamber 12A, each of the ends of the lower electrode film 60 and the upper electrode film 80 of the piezoelectric element 300 is formed in parallel to the end surface 12*a* or the end surface 12*b* of the pressure generating chamber 12A. That is, in the second embodiment, the configuration of the ink supply passage 13A and the shape of the ink supply passage 13A of the pressure generating chamber 12A are different from those in the first embodiment.

With such a configuration, a distances between the end surface 12*b* of the pressure generating chamber 12A and each of ends 60*b* and 80*b* of the piezoelectric element 300 opposite the end surface 12*b* is the same as the distances d1 and d2 ((a) of FIG. 3) between the ends 60*a* and 80*a* of the piezoelectric element 300 and the end surface 12*a* of the pressure generating chamber 12 in the first embodiment, and is substantially uniform. In addition, the second (111) plane forming the end surface 12*a* of the pressure generating chamber 12A is inclined by a predetermined angle θ (about 70.53 degree) with respect to the first (111) plane, like the first embodiment. In this case, since the pressure generating chamber 12A has the parallelogram shape, the second (111) plane forming the end surface 12*a* and the second (111) plane forming the end surface 12*b* are parallel to each other.

With such a configuration, the predetermined angle θ is formed by the end surface 12*a* (the second (111) plane) of the pressure generating chamber 12A and the first (111) plane. Accordingly, the end surfaces 12*a* and 12*b* of the pressure generating chamber 12A, which are formed by surfaces which appear by anisotropy of the passage forming substrate 10 formed of the silicon single crystal substrate, can be smoothly etched. In addition, the vibration plate formed by the elastic film 50, the insulating film 55, and the lower electrode film 60 vibrates by using an end side 12*c*, which is the end of the end surface 12*a*, as a vibration position. In this case, the length of the end side 12*c* as the vibration position can be set to be longer, compared to a case where the predetermined angle θ is a right angle. Accordingly, since stress per unit length of the end side 12*c*, which is caused due to vibration of the piezoelectric element 300, is reduced, a lift span of the vibration plate is improved.

Since the piezoelectric layer 70 is continuously formed up to the outside of the pressure generating chamber 12A, an advantage of scattering stress which occurs in the boundary between the pressure generating chamber 12A and the partition wall 11 in the vibration plate can be obtained like the first embodiment. Moreover, since the pressure generating chamber 12A, the lower electrode film 60, and the upper electrode film 80 have a substantially similar shape in plan view, as shown in (a) of FIG. 4, the pressure caused by the piezoelectric element 300 is more uniformly transferred to ink. Accordingly, even when the ink is ejected as the more minute liquid droplets from the nozzles 21, it is possible to stably control the ejection of the liquid droplets.

In the first and second embodiments, the piezoelectric layer 70 extends up to the outside of the pressure generating chamber 12 and the lead electrode 90 is disposed on the piezoelectric layer 70, but the configuration of the lead electrode 90 is not particularly limited. For example, each of the piezoelectric elements 300 may be covered with a protective film made of an insulating material, each of the lead electrodes may be formed on the protective film, and the lead electrode and the upper electrode film may be connected to each other through a contact hole formed in the protective film. In addition, the shape of the pressure generating chamber 12A is not limited to the parallelogram shape processed by etching. When the predetermined angle θ is processed as an acute angle or an obtuse angle in the silicon single crystal substrate having the surface direction (110) which is the passage forming substrate 10, an advantage of improving a durable period of the vibration plate can be obtained.

Figure 5:
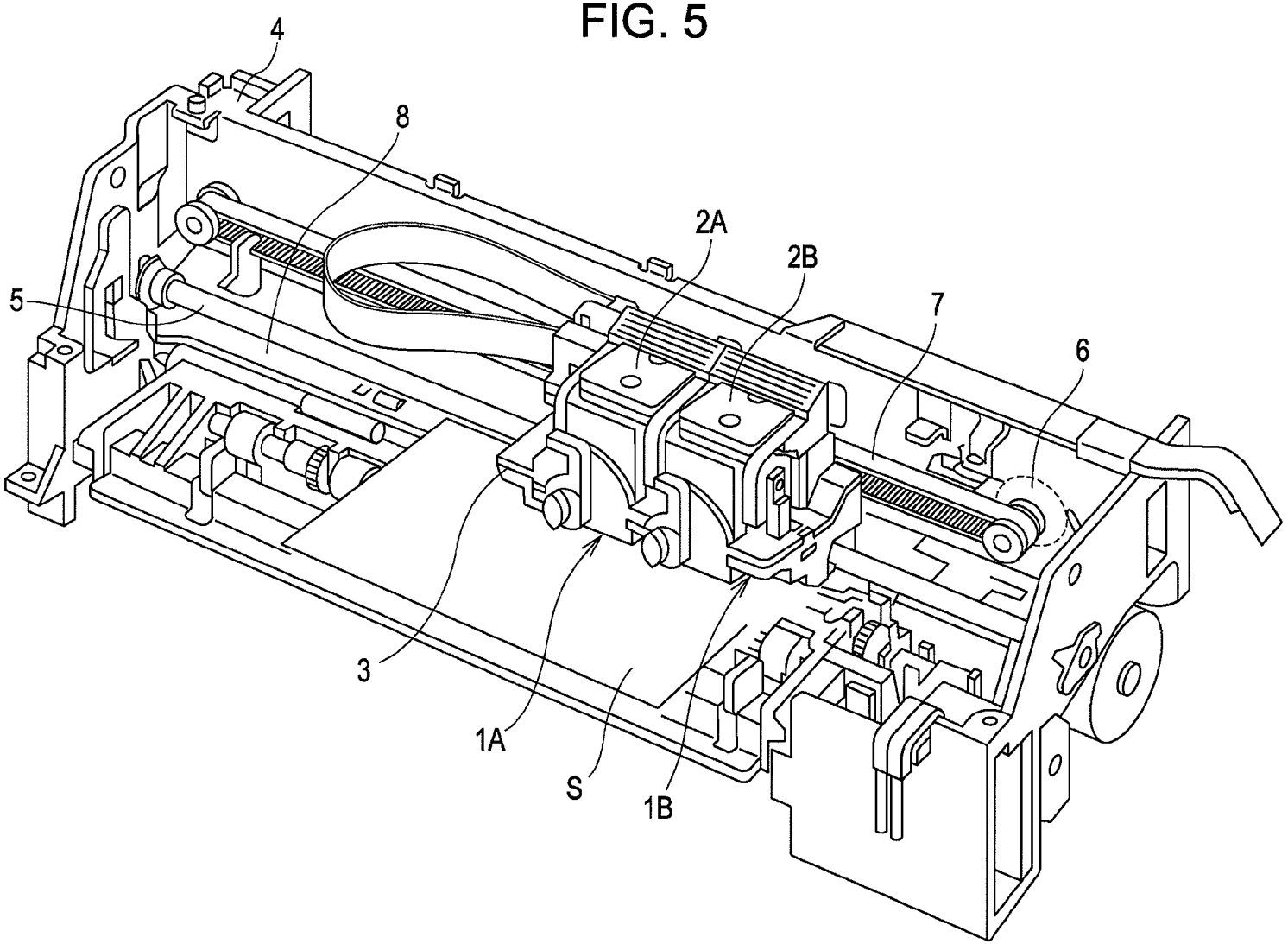
FIG. 5 is a schematic diagram illustrating a printing apparatus according to the embodiment.

The ink jet print head 1 described above forms a part of a print head unit including an ink passage communicating with an ink cartridge or the like and is mounted on an ink jet printing apparatus. FIG. 5 is a schematic diagram illustrating an example of the ink jet printing apparatus. As shown in FIG. 5, print head units 1A and 1B configured by the ink jet print head 1 are provided so that cartridges 2A and 2B serving as ink supply means are detachably mounted. A carriage 3 mounted with the print head units 1A and 1B is provided to be freely movable in a shaft direction along a carriage shaft 5 attached to an apparatus main body 4. The print head units 1A and 1B are configured to eject black ink and color ink, respectively, for example. The carriage 3 mounting the print head units 1A and 1B is moved along the carriage shaft 5, since a driving force of a driving motor 6 is delivered to the carriage 3 through a plurality of toothed-gears (not shown) and a timing belt 7. On the other hand, a platen 8 is formed along the carriage shaft 5 in the apparatus main body 4. In addition, a print sheet S as a print medium such as a paper sheet fed by a feeding roller or the like (not shown) is transported to the platen 8. The first and second embodiments can be applied to a liquid jet apparatus mounting a liquid jet head other than the ink jet print head 1.

In the above-described first and second embodiments, the ink jet print head 1 is used as an example of the liquid jet head. However, the invention can be broadly applied to various liquid jet heads and thus can be applied to a liquid jet head ejecting a liquid other than ink. Examples of the liquid jet head include various print heads used for an image recording apparatus such as a printer, a color material jet head used to manufacture a color filter such as a liquid crystal display, an electrode material jet head used to form electrodes such as an organic EL display or an FED (Field Emission Display), and a bio organism jet head used to manufacture a bio chip.

What is claimed is:

1. A liquid jet head comprising:

a passage forming silicon substrate having a pressure generating chamber with a crystal face orientation of a surface being a (110) plane wherein the pressure generating chamber communicates with a liquid droplet ejecting nozzle;

wherein the pressure generating chamber has a longitudinal direction and a width direction; and wherein the pressure generating chamber has a first (111) plane along the width direction and a second (111) plane along the longitudinal direction;

an elastic film disposed above the pressure generating chamber; and a piezoelectric element having a lower electrode, a piezoelectric layer, and an upper electrode disposed above the elastic film;

wherein both ends of the lower electrode and both ends of the upper electrode in the longitudinal direction are located in a region corresponding to the pressure generating chamber; and wherein one edge of the lower electrode and one edge of the upper electrode in the width direction are parallel to the first (111) plane of the pressure generating chamber.

2. The liquid jet head according to claim 1, wherein the piezoelectric layer extends from one end in the region corresponding to the pressure generating chamber to the outside of the region corresponding to the pressure generating chamber in the longitudinal direction, and a lead electrode having an end connected to the upper electrode that extends onto the piezoelectric layer to be drawn to the outside of the region corresponding to the pressure generating chamber in the longitudinal direction.

3. The liquid jet head according to claim 1, wherein the angle between the first (111) plane and the second (111) is an acute angle or an obtuse angle.

4. A liquid jet apparatus comprising the liquid jet head according to claim 1.

* * * * *